US006436241B1

(12) United States Patent
Persson et al.

(10) Patent No.: US 6,436,241 B1
(45) Date of Patent: Aug. 20, 2002

(54) SUCTION ROLL SEAL STRIP WITH WEAR INDICATOR

(75) Inventors: Rolf Persson; Lars Eriksson, both of Sunne; Bengt Åkerblom, Vårby, all of (SE)

(73) Assignee: JoCell Aktiebolag, Kil (SE)

( * ) Notice: Subject to any disclaimer, the term of this patent is extended or adjusted under 35 U.S.C. 154(b) by 0 days.

(21) Appl. No.: 09/869,690

(22) PCT Filed: Oct. 8, 1999

(86) PCT No.: PCT/SE99/01802

§ 371 (c)(1),
(2), (4) Date: Jul. 3, 2001

(87) PCT Pub. No.: WO00/43592

PCT Pub. Date: Jul. 27, 2000

(30) Foreign Application Priority Data

Jan. 7, 1999 (SE) ..... 9900014

(51) Int. Cl.[7] ..... D21F 3/10
(52) U.S. Cl. ..... 162/371; 162/272; 277/321
(58) Field of Search ..... 162/272, 371, 162/369; 277/321, 317

(56) References Cited

U.S. PATENT DOCUMENTS

| | | | | | |
|---|---|---|---|---|---|
| 4,497,493 | A | * | 2/1985 | Sall et al. | 277/321 |
| 5,246,235 | A | * | 9/1993 | Heinzen | 277/321 |
| 5,746,891 | A | | 5/1998 | Withers | 162/371 |
| 6,003,872 | A | * | 12/1999 | Nord | 277/321 |

FOREIGN PATENT DOCUMENTS

| | | | | |
|---|---|---|---|---|
| JP | 352031263 | * | 3/1977 | 277/321 |
| JP | 354117852 | * | 9/1979 | 277/321 |
| JP | 4-327069 | * | 11/1992 | |
| SU | 976166 | * | 11/1982 | 277/321 |

* cited by examiner

*Primary Examiner*—Karen M. Hastings
(74) *Attorney, Agent, or Firm*—Birch, Stewart, Kolasch & Birch, LLP

(57) ABSTRACT

Seal strip for a hollow circular cylindrical screening device, which screening device is intended to be used in a paper or cardboard machine for the production of paper or cardboard, the seal strip having an indicator for indicating wear of the seal strip. The indicator is arranged to continuously give a measure of a remaining wear allowance and preferably also a wear rate, of the seal strip.

4 Claims, 1 Drawing Sheet

SUCTION ROLL SEAL STRIP WITH WEAR INDICATOR

This application is the national phase under 35 U.S.C. §371 of PCT International Application No. PCT/SE99/01802 which has an International filing date of Oct. 8, 1999, which designated the United States of America and was not published in English.

TECHNICAL FIELD

The present invention relates to a seal strip for a hollow circular cylindrical screening device, which screening device is intended to be used in a paper or cardboard machine for the production of paper or cardboard, said seal strip exhibiting indicator means for indicating wear of the seal strip. The seal strip is e.g. intended to be used to seal between a vacuum box which is arranged inside the screening device, and the mantle of the screening device.

STATE OF THE ART AND PROBLEMS

In the production of paper or cardboard, a continuous process for the dewatering of a paper pulp of cellulosic fibres is used, in order to form a sheet material. In connection with the dewatering there is thereby used so called suction rolls, i.e. hollow, rotating, circular cylindrical screening devices, in a paper or cardboard machine. Such suction rolls may be of different types, e.g. formation rolls which control the formation of the sheet, pick-up rolls which guide the pulp web, couch rolls or press suction rolls. One example where a suction roll is used is a suction roll where the paper pulp is spread over the length of the suction roll and forms a web around at least a part of the circumference of the suction roll, whereby liquid is sucked from the paper pulp and through the perforated mantle of the suction roll. A vacuum box is thereby stationary arranged inside the suction roll, along a circular arc of its circumference and along its entire length, whereby an underpressure in the vacuum box leads to liquid being forcedly sucked out from the paper pulp when it passes over the area of the vacuum box. Usually there is also arranged a press roll in order to press out liquid from the paper pulp, in a press nip with contact between the suction roll and the press roll. Dewatering in a press nip is typically performed before the paper pulp web is brought to pass over the area of the vacuum box.

The vacuum box, which is used in all types of suction rolls, is arranged to seal against the inside of the mantle surface of the suction roll by aid of two or more seal strips, which are arranged in parallel to each other, with an angular distance which corresponds to the extension of the vacuum box. When more than two seal strips are used, the vacuum box may be divided into several vacuum zones. The seal strips exhibit an arc shaped sealing surface, at least after having been used a certain time period, and slide against the mantle surface at the inside of the screening device as it rotates, whereby the seal strip is gradually worn during the continuous operation. At the short ends of the vacuum box, there is arranged gable sealings. In order to limit the wear and in order to give an enhanced sealing, water is normally sprayed against the mantle surface on the inside of the screening device in a position before the first seal strip as seen in the direction of rotation. The seal strips are nevertheless worn and must accordingly be replaced at even intervals. Since the paper machine is operating continuously, it may take several months before it is stopped for service, including checking of the seal strips which are being used. Quite often, they are thereby replaced either at closer intervals than necessary or far too seldom. The first case is uneconomical, since the seal strips are thrown away before their life time is finished and the second case is uneconomical since the efficiency of the suction roll decreases at operation with too worn seal strips. During operation, there is no possibility to check the wear.

In U.S. Pat. No. 5,746,891, there is presented wear indicators for seal strips for suction rolls, which wear indicators are checked when the plant is closed down and which at that point give an indication as to whether the wear allowance of the seal indicators has been used up or if there is additional life time left. According to one embodiment, the wear indicators consist of bores in the sealing surface, which bores are spaced apart and filled with a coloured material, whereby the material may exhibit different colours at different depths. The colour which appears at the time of the check thereby indicates how much wear allowance is left. According to another embodiment, isolated electrical conductors are arranged in intervals along the seal strip, inside the same. When the seal strip has been worn all the way down to these conductors, the insulation on the conductors are worn off too, and there is formed an electrical circuit, via the liquid in the system, whereby a signal lamp is illuminated.

The drawback of the seal strips shown in U.S. Pat. No. 5,746,891 is that there, in the first embodiment, is no control of the wear at all until the plant is stopped for service, whereby at service, at least the machine clothing must be taken off or whereby in practice, the roll has to be opened. In the second embodiment, there is at the other hand only an indication when the signal lamp is illuminated. If this lamp is illuminated e.g. only a short time period after the plant having been stopped for service, this means that the plant must be stopped again for change of the seal strip. Accordingly, the seal strips according to U.S. Pat. No. 5,746,891 do not give an opportunity of continuous surveillance of the remaining wear allowance of the strips.

DESCRIPTION OF THE INVENTION

The object of the present invention is to solve the above mentioned problems, whereby there is presented a seal strip with indicator means arranged to continuously give a measure of a remaining wear allowance if the seal strip.

According to one aspect of the invention, said indicator means or at least a transmitter therefore, is mounted inside the seal strip, which seal strip at least in the main consists of a magnetically non-conducting material, preferably graphite, whereby the indicator means is arranged to continuously measure a distance between the indicator means, or the transmitter, and a surface against which the seal strip is arranged to seal.

According to another aspect of the invention, said indicator means include measuring based on electromagnetism. The methods of measurement may thereby be the per se known methods reluctance measurement, inductive measurement or eddy current measurement, reluctance measurement being the most preferred. Reluctance measurement is advantageous since it is a method by which the measurements are adequately precise, stable and independent of material and temperature variations in the mantle of the screening device. If a lower preciseness and stability can be accepted, the measurement may however be performed by inductive or eddy current method.

According to another aspect of the invention, there may instead be used a level indicator as indicator means, preferably of the potentiometer type, which is arranged to measure the position of a fixed point at or in the seal strip. Thereby, the level indicator continuously shows how the seal strip is displaced upwards as the wearing takes place (the displacement is explained in greater detail in the description of the figure), whereby the displacement and thereby also the value measured by the level indicator may indirectly and continuously give a measure of the remaining allowance.

According to yet another aspect of the invention, there is offered a possibility to continuously measure and thereby to continuously give a measure of the wear rate of the seal strip in mm/hour or rather $\mu$m/hour. The system may also be provided with a warning signal, e.g. in the form of a lamp or tone, whereby the operator's attention may be drawn to an increased wear rate so that he can undertake the necessary actions in order to decrease the wear rate, e.g. by increased liquid spray etc. In order to be able to get a measure of the wear rate, there is required a precise measurement, in the form of reluctance measurements.

According to another aspect of the invention, a temperature transmitter is arranged in connection with the indicator means or its transmitter, inside the seal strip. This temperature transmitter is continuously giving a measure of the temperature, whereby a warning signal may be given e.g. when the temperature exceeds 100° C., which is only the case if there is a liquid shortage. Then, the operator may increase the liquid spray or take other necessary precautions in order to lower the temperature.

The great advantage with the seal strip according to the invention is that a continuous measure of the remaining wear allowance may be given, which measure is precise and stable. Other advantages are the possibility to get a continuous measure of wear rate and temperature.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE DRAWING

The invention will in the following be described in greater detail with reference to FIG. 1, which is showing a seal strip in cross section including indicator means which operates according to the reluctance method.

Figure 1:
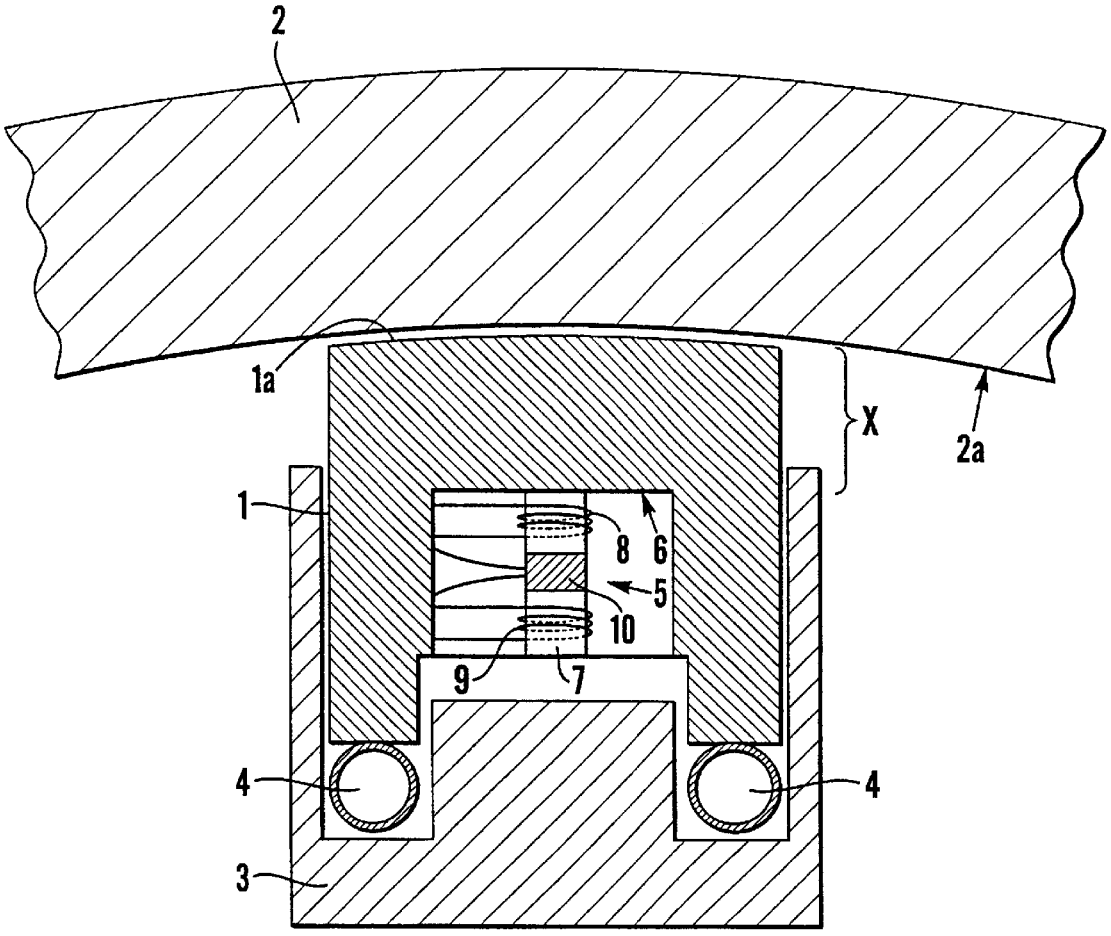
In FIG. 1 there is shown a seal strip 1, in cross section, for a not shown vacuum box, which seal strip 1 is abutting an internal mantle surface 2*a* of a rotating screening device. The mantle 2 of the screening device is perforated (not shown), for the passing through of liquid from a mat of paper pulp, which runs along with the screening device in its rotation, on the outside of the mantle 2 of the screening device. The mantle of the screening device is manufactured in a magnetically conductive material, usually stainless steel. The seal strip itself is, on the other hand, manufactured in a magnetically non-conductive material, usually graphite, preferably rubber graphite, which is a mixture of rubber and graphite. Other conceivable materials are polymeric materials, e.g. plastics or teflon. The seal surface 1*a* of the seal strip exhibits an arched shape in its cross section, which essentially corresponds to the curvature of the mantle surface 2*a*. Totally planar surfaces are also conceivable, but will in time be worn to an arched shape. The seal strip 1 is typically of the same length as the screening device, i.e. normally about 3–11 meters long, although even longer seal strips/suction rolls are conceivable.

The seal strip 1 is arranged in a stationary profile 3, the shape of which essentially corresponds to the bottom side shape of the seal strip. Between the seal strip 1 and the profile 3, there is arranged one or more, in the shown embodiment two, inflatable tubes 4 of an extensible material, e.g. a polymeric material, preferably rubber. When the seal strip 1 is new, the tube is collapsed. The prevailing wear allowance of the seal strip has been indicated with x. When the seal strip is worn, due to friction against the abutting, rotating mantle 2, the distance x is decreasing, whereby the cross sectional shape of the tube is changed into a circular cross section and is possibly changed to a non circular cross sectional shape. The air pressure in the tube is constant, about 0.2–1.5 bar. The tube 4 will, in connection with its changing cross section, displace the seal strip 1 upwards, so that its abutment against the mantle surface 2*a* is retained. After having been used for a certain time period, the entire wear allowance x will however have been used, whereby the seal strip 1 has to be replaced.

According to the invention, the wearing may be continuously monitored, so that the operator will be continuously informed of the remaining wear allowance and wear rate. This is made possible by an indicator means with a transmitter 5, which is only shown schematically, which indicator means operates according to the reluctance method in the shown embodiment, i.e. a method which is based on measurements of magnetic resistance.

Thereby, the indicator means is arranged to measure the distance between the mantle surface 2*a* and a surface 6 of a transmitter 5 for the indicator means, inside the seal strip 1.

The wear allowance x, or preferably a full measure of the wear allowance x, of a magnetically non-conductive material, preferably graphite or rubber graphite, which material is included as a part of a reluctance measuring circuit, is positioned between said two surfaces 6 and 2*a*.

The transmitter 5 for the indicator means is arranged in the surface 6 and comprises a core 7, about which two coilings 8 and 9 are arranged. The core is made of a highly permeable material, in a magnetic sense. The two coilings are being fed with a current, to make them operate in opposite directions. Between the coilings, there is arranged a direct current meter 10. The two currents which are being fed to the two coilings 8, 9 are adjusted to make a resulting magnetic field through the direct current meter 10 being equal to zero. When the distance between the two surfaces 6 and 2*a* is altered, following the wearing, the reluctance for the part of the transmitter which is being fed from the coiling 8 is altered, whereby a flow through the direct current meter 10 arises. The direct current meter reacts on the flow and controls, via a not shown zero-detector, a current generator which alters the current feed to the coiling 8 so that the resulting flow through the direct current meter 10 becomes equal to zero again. The output measure, which is a measure of the difference between the two currents to the coilings 8 and 9, will continuously be proportional to the distance between the two surfaces 6 and 2*a*. The indicator equipment may thereby be adjusted to continuously show the remaining wear allowance x, which is suitably somewhat less than the distance between the surfaces 6 and 2*a*, whereby possible indicator signals or the like, e.g. warning lamps or warning tones, may be used in order to effect a warning when the wear allowance is completely used up or when only a small part of it remains. Furthermore, the indicator equipment may be adjusted to show the wear rate and moreover, the temperature may be monitored by aid of a (not shown) temperature transmitter which is arranged in connection with the transmitter 5.

The coilings are suitably fed by a direct current which is alternating its direction at a low frequency in order to avoid eddy current losses. By use of an alternating direct current, problems with stationary interference fields such as the terrestrial magnetic field is eliminated, and moreover, the remanence dependence in connection with measurements on steel surfaces, is decreased. Suitably, the alternating direct current has the shape of a square wave.

Indicator means 5 are arranged at even intervals along the length of the seal strip, e.g. a total of 1–7 pieces, preferably 2–5 pieces in each seal strip. This makes it possible to achieve a continuous indication of a possible uneven wear along the length of the seal strip, whereby measurements in order to counteract this uneven wear may be taken early.

The invention is not limited to the embodiments described above, but may be varied within the scope of the patent claims. The seal strip may e.g. be of a type which is known per se, which comprises means for locking the position of the seal strip in height. At such a locking, there is no need for a continuous air pressure in the below lying tubes 4.

What is claimed is:

1. A seal strip in a hollow circular cylindrical screening device, which screening device is used in a paper or cardboard machine for production of paper or cardboard, the seal strip comprising indicator means for indicating wear of the strip, the indicator means being arranged to continuously give a measure of a remaining wear allowance of the seal strip while the seal strip is in use, the indicator means has a transmitter being mounted inside the seal strip, the seal strip includes magnetically non-conductive material, whereby the transmitter is arranged to continuously measure a distance between the transmitter and a surface against which the seal strip is arranged to seal, the indicator means uses reluctance measurements and the transmitter and the surface are oriented in relation to each other so that the part of the seal strip which is positioned between therebetween is included as a part of a reluctance measuring circuit, whereby the transmitter comprises a core about which two coilings are arranged to be fed by a current and a direct current meter arranged between the coilings, so that said coilings operate in opposite directions, whereby a resulting magnetic flow through the direct current meter is adjusted be equal to zero, by control of said currents and whereby measure of remaining wear allowance of the seal strip is achieved on a basis of a difference between the currents.

2. The seal strip according to claim 1, wherein the indicator means is arranged to continuously, directly or indirectly, give a measure of a wear rate of the seal strip.

3. The seal strip according to claim 1, wherein the seal strip seals between a vacuum box arranged inside the screening device and an internal mantle surface of the screening device.

4. The seal strip according to claim 1, wherein the coilings are being fed by an alternating direct current.

* * * * *